US005222270A

United States Patent [19]

Sloter et al.

[11] Patent Number: 5,222,270

[45] Date of Patent: Jun. 29, 1993

[54] ELECTROMAGNETIC MOTOR BRAKE UNIT FOR ROTARY DRAIN AND SEWER ROUTER

[75] Inventors: Rockwell T. Sloter; Roy Salecker, both of Mendota, Ill.

[73] Assignee: Spartan Tool, a Div. of Heico, Inc., Mendota, Ill.

[21] Appl. No.: 850,288

[22] Filed: Mar. 12, 1992

[51] Int. Cl.[5] ..... B08B 9/02

[52] U.S. Cl. ..... 15/104.33; 310/77; 226/11

[58] Field of Search ..... 15/104.33; 226/11, 25; 408/16; 310/77

[56] References Cited

U.S. PATENT DOCUMENTS 4,734,604 3/1988 Sontheimer et al. ..... 310/77
4,811,820 3/1989 Rossi ..... 310/77
5,031,276 7/1991 Babb et al. ..... 15/104.33

*Primary Examiner*—Edward L. Roberts
*Attorney, Agent, or Firm*—Wood, Phillips, VanSanten, Hoffman & Ertel

[57] ABSTRACT

An apparatus for routing a passageway in a conduit includes an elongate cable for direction into a conduit passageway. A cable supply drum contains a supply of the cable and is rotatable about an axis, there being a length of the cable projecting to outwardly of the drum. A motor selectively imparts rotation to the drum about the axis. The cable and drum are configured such that the projecting length of cable rotates about its length as an incident of the drum being rotated about its axis. A brake is provided for stopping rotation of the drum and thereby rotation of the projecting length of cable so as to prevent torquing of the projecting length of cable as when the projecting length of cable is prevented by freely rotating by an obstruction encountered in a conduit passageway.

14 Claims, 2 Drawing Sheets

ELECTROMAGNETIC MOTOR BRAKE UNIT FOR ROTARY DRAIN AND SEWER ROUTER

BACKGROUND OF THE INVENTION

1. Technical Field

The present invention is directed toward rotary drain and sewer routers having a cable advancable from a rotatable drum containing a supply of the cable and, more particularly, toward a brake for such drain and sewer routers for selectively stopping rotation of the drum.

2. Background Art

One type of widely used rotary drain and sewer router has a wheeled frame for transporting the drain and sewer router. A cable supply drum rotatable about an axis is mounted to the wheeled frame. A supply of an elongate cable for direction into a drain or sewer is contained within the drum and a length of the cable extends from the drum. The cable is attached to the drum so that upon rotation of the drum about its axis the length of cable extending from the drum rotates about its length. An electric motor is also attached to the wheeled frame. A pulley is attached to a drive shaft extending from the electric motor. A belt is looped around the pulley and radially around the periphery of the drum so that upon rotation of the pulley by the motor the belt causes rotation of the drum about its axis. A cable feed apparatus engages the extending length of the cable to feed the cable into or out of the drum as an incident of rotation of the drum about the axis.

When such a rotary drain and sewer router is used to rout a drain, a cutting tool having a number of sharp blades is attached to the extending length of the cable and fed into the drain or sewer. The motor is then turned on and the drum caused to rotate. The cable feed apparatus causes the cable to be fed from the drum into the drain. Typically, the cutting tool will be fed into the drain until an obstruction is encountered, at which time the cutting tool will cut through the obstruction, clearing a passageway in the drain. However, occasionally the cutting tool will encounter an obstruction which it is unable to cut and the cutting tool may become entangled with the obstruction and rotation of the end of the extending length of cable stopped. Even if the motor is immediately stopped the mass of the cable supply drum causes it to continue rotating, notwithstanding frictional forces within the motor tending to slow the rotation of the drum. The continued rotation of the drum under these circumstances creates a torque in the cable which can actually cause the wheeled frame to tip, creating a risk of grievous harm to an operator, the rotary drain and sewer router or equipment in the area until the drum ceases rotating. A related problem is while the torque on the cable may not cause tipping of the wheeled frame, it may cause the drum to rotate in an opposite direction, causing whipping of the protruding length of cable and a potential for harm to an operator. Another related problem is that occasionally the protruding length of cable will become severed as it is fed into a sewer or drain. Should the severing result in the cable leaving the sewer or pipe, the cable will spin and whip uncontrollably, creating a potential for serious harm until the drum is brought to rest.

SUMMARY OF THE INVENTION

The present invention is directed toward overcoming the problems discussed above.

The present invention is a rotary router for routing a passageway in a conduit. The router includes an elongate cable for direction into a conduit passageway. A drum containing a supply of the cable is rotatable about an axis, there being a length of the cable projecting to outwardly of the drum. A motor selectively imparts rotation to the drum about the drum axis. The cable and drum are configured such that the projecting length of cable rotates about its length as an incident of the drum being rotated about its axis. A brake is provided for stopping rotation of the drum and thereby rotation of the projecting length of cable so as to prevent torquing of the projecting length of cable as when the projecting length of cable is prevented from freely rotating by an obstruction encountered in a conduit passageway.

Preferably, the rotation imparting motor includes a rotatable drive shaft rotatably coupled to the drum so that the drum rotates as an incident of the rotation of the drive shaft with there being a supply powering the motor so that the motor imparts rotation to the drive shaft. The brake includes a structure for halting rotation of the drive shaft and thereby ceasing rotation of the drum and the protruding length of cable. The brake preferably selectively halts rotation of the drive shaft and thereby rotation of the drum substantially instantaneously upon the power supply being cut off. The brake is preferably electromagnetically biased to a disabled position in which it does not halt rotation of the drive shaft so long as electric power flows to the brake but will halt rotation of the drive shaft when electric power is cut off. Electric power may be selectively supplied to the brake so that it will be electromechanically biased so as to not halt rotation of the drive shaft regardless of power to the motor being cut off.

The rotary drain and sewer router having a cable supply drum brake of the present invention stops rotation of the cable supply drum to prevent excess torque from developing in the cable which can cause the cable to snap and spin and whip wildly, cause the drain and sewer cleaning apparatus to become unstable and tip, or cause a reverse rotation of the drum and resulting whipping of the protruding length of cable, any one of which may cause great injury. The brake substantially instantaneously stops rotation of the drum to minimize potential harm. Because the brake is electromagnetically biased in a non-braking position, the brake and motor can be electrically coupled to a single power supply so that upon cutting off power to the motor, the brake will be immediately and automatically activated to substantially instantaneously halt the rotation of the drum. Thus, the brake of the present invention acts to reduce potential harm from a freely rotating cable supply drum and associated cable before harm to operators or surrounding property.

DETAILED DESCRIPTION OF THE PREFERRED EMBODIMENT

Figure 1:
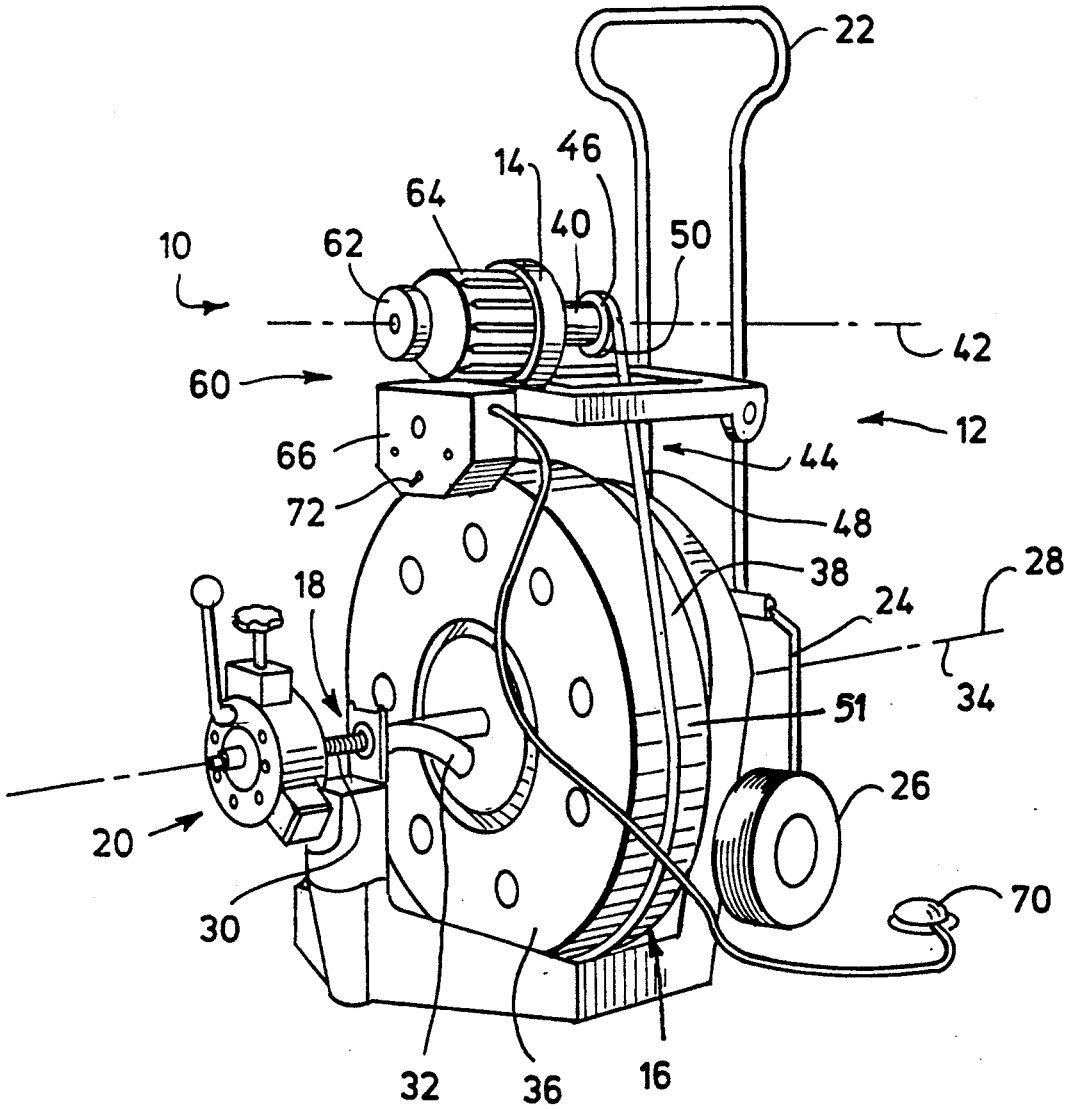
FIG. 1 is a perspective view of a rotary drain and sewer router including an electromagnetic motor brake assembly of the present invention.

An apparatus 10 for routing a passageway in a conduit such as a drain or sewer is illustrated in FIG. 1. The rotary drain and sewer router 10 includes a frame 12, an electric motor 14, a cable supply drum 16, a cable 18 projecting from the cable supply drum 16, and a cable feed apparatus 20.

The frame 12 includes a handle 22 and a body 24 with a pair of wheels 26 (only one shown) mounted to the body 24 to facilitate movement of the drain and sewer router 10.

The cable supply drum 16 is mounted to the frame body 24 for rotation about a fixed axis 28. A supply of cable 18 is contained in the cable supply drum 16 with a length of the cable 30 projecting to outwardly of the drum 16. The cable 18 is mounted to the interior of the drum 16 in a known manner so that upon rotation of the drum 16 about the fixed axis 28 the projecting length of cable 30 is caused to rotate about its length. Sheaths 32 cover a part of the projecting length of cable 30 extending directly from the cable supply drum 16. The cable supply drum 16 is preferably cylindrically shaped with its axis 34 coaxial with the axis of rotation 28. The cable supply drum further includes a front wall 36 and a back wall (not shown) joined by a cylindrical side wall 38.

The electric motor 14 has a drive shaft 40 mounted for rotation about an axis 42. A belt and pulley drive 44 links the drive shaft 40 to the cable supply drum 16 so that the cable supply drum 16 and the drive shaft 40 both rotate as an incident of rotation of the other. The belt and pulley drive 44 includes a pulley 46 keyed to the drive shaft 40 for rotation about the axis 42. A belt 48 engages a peripheral surface 50 of the pulley 46 and the outer surface 51 of the side wall 38 of the cable supply drum 16 so that rotation of the drive shaft 40 by the electric motor 14 causes rotation of the cable supply drum 16 about the axis of rotation 28.

An electromagnetic brake assembly 60 is connected to the electric motor 14 for braking rotation of the cable supply drum 16 to thereby stop rotation of the projecting length of cable 30. The electromagnetic brake assembly includes an electromagnetic brake 62 mounted to the housing 64 of the electric motor 14. The electromagnetic brake 62 acts on the drive shaft 40 to halt rotation of the drive shaft 40. Because the belt and pulley drive 44 links rotation of the drive shaft 40 to rotation of the cable supply drum 16, upon braking of the drive shaft 40 the cable supply drum 16 is also braked to halt rotation of the cable drum 16 about the rotation of axis 28. As an incident of the cable supply drum 16 ceasing to rotate about the axis 28, the projecting length of cable 30 ceases to rotate about its length.

The electromagnetic brake 62 is normally electromagnetically biased to a disabled state so as to not brake the drive shaft 40 in a manner well known in the art. However, upon electric power being cut off to the electromagnetic brake 62, the electromagnetic brake acts to brake the rotation of the drive shaft 40. Preferably, the electromagnetic brake 62 will halt rotation of the drive shaft 40 substantially instantaneously upon the cutoff of electric power to the electromagnetic brake 62.

Figure 2:
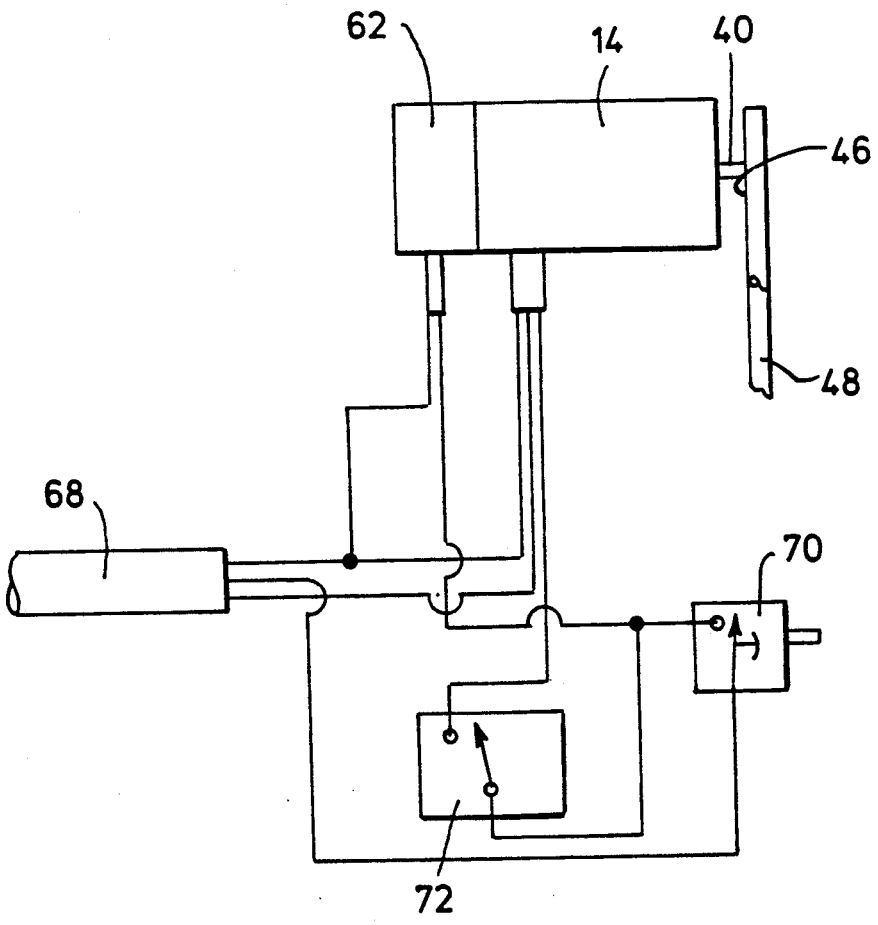
FIG. 2 is a schematic drawing illustrating the electrical connection between a power supply and the electromagnetic brake and the electric motor of the rotary drain and sewer router of FIG. 1.

A circuitry housing 66 contains the circuitry of the electromagnetic brake assembly 60. The circuitry is illustrated in FIG. 2. An electric power supply 68 is electrically coupled to the electromagnetic brake 62 and the electric motor 14. A first switch 70 is electrically coupled to the power supply 68 and the electromagnetic brake 62 and electric motor 14. The first switch 70 is selectively changeable from an open position cutting off power to the motor 14 and the electromagnetic brake 62 and a closed position allowing power to flow to the motor 14 and the electromagnetic brake 62. A second switch 72 is electrically coupled to the power supply 68 and the electric motor 14 to, in an open position, selectively cut off electric power to the electric motor 14 when the first switch 70 selectively allows power to flow to the electric motor 14 and the electromagnetic brake 62. Thus, with the second switch 72 open and the first switch 70 closed, power flows to the electromagnetic brake 62 and not the electric motor 14. With both the first switch 70 and the second switch 72 closed, electric power flows to both the electromagnetic brake 62 and the electric motor 14.

The router 10 functions as follows. When the first switch 70 is closed and the second switch 72 is closed, electric power flows to the electric motor 14 causing rotation of the drive shaft 40 and electric power flows to the electromagnetic brake 62 biasing it toward a disabled position wherein it does not halt rotation of the drive shaft 40. The drive shaft 40 then causes rotation of the pulley 46 which in turn rotates the belt 48, causing the cable supply drum 16 to rotate about its axis 28. The projecting length 30 of cable 18 thereby rotates lengthwise. By manipulation of the cable feed apparatus 20, the cable 18 is caused to rotate in an idle position or is fed into or out of the cable supply drum 16. Exemplary cable feed apparatus are shown in U.S. Pat. Nos. 3,394,599 (Tucker) and 3,451,090 (Lo Presti et al.), which are incorporated herein by reference. Upon opening the switch 70 the electromagnetic brake 62 is no longer electromagnetically biased to a disabled position not braking the drive shaft 40 and brakes the drive shaft 40. Thus, the electromagnetic brake 62 halts rotation of the drive shaft 40, thereby halting rotation of the cable supply drum 16 and the projecting length of cable 30.

Under some circumstances, such as when a cutting tool (not shown) or the like is being attached to the projecting length of cable 30, it is desirable to manually rotate the supply drum 16. The electromagnetic brake 62 can be disengaged by opening the second switch 72 and closing the first switch 70, thereby allowing free manual rotation of the cable supply drum 16.

As seen in FIG. 1, the first switch 70 is preferably a foot operated electrical switch which is normally in the open position and put into a closed position by pushing on the switch 70 as, for example, by a foot of an operator. The second switch 72 is preferably located on the circuitry housing 66. During a routing operation, the switch 72 is closed and during insertion of the projecting length 30 of cable 18 into a conduit or withdrawal of the projecting length 30 of cable 18 from a conduit the operator depresses the first switch 70 with his foot. If the cutting tool engages an obstruction halting rotation of the projecting length 30 of cable 18, the operator may step off the first switch 70, opening the switch, thereby causing the electromagnetic brake 62 to brake the drive shaft 40, thereby substantially instantaneously halting rotation of the cable supply drum 16 before an excessive torque is applied to the cable 18. In a like manner, if the cable 18 should become severed, an operator can substantially instantaneously stop the rotation of the projecting length 30 of the cable 18 by stepping off the first switch 70.

The drain and sewer router including the electromagnetic brake of the present invention presents a significant advancement in safety over prior art rotary drain and sewer routers. The electromagnetic brake permits substantially instantaneous stopping of rotation of the cable supply drum and therefore the projecting length of cable before a torque sufficient to cause tipping of the rotary drain and sewer router, breakage of the cable or reverse rotation of the cable supply drum and whipping of the protruding length of cable results. Moreover, because the electromagnetic brake may selectively be disengaged when power to the motor driving the rotary drain and sewer cleaning apparatus is cut off, the cable supply drum can be manually rotated for attaching cutting tools and the like to the projecting length of cable or for manually feeding the projecting length of cable into a pipe or sewer.

What is claimed is:

1. An apparatus for routing a passageway in a conduit, the routing apparatus comprising:

an elongate cable for direction into a conduit passageway;

a drum containing a supply of the cable, the drum being rotatable about an axis, there being a length of the cable in said drum that projects to outwardly of the drum;

means for selectively imparting rotation to the drum about the axis;

cooperating means on the cable and drum for causing the projecting length of cable to rotate about its length as an incident of the drum being rotated about its axis; and means for braking the drum rotation to thereby stop rotation of the projecting length of cable about its length so as to prevent torquing of the projecting length of cable as when the projecting length of cable is prevented from freely rotating by an obstruction encountered in a conduit passageway.

2. The routing apparatus of claim 1 wherein the braking means comprises:

means for stopping the rotation imparting means and means for stopping rotation of the drum as an incident of the rotation imparting means being stopped.

3. The routing apparatus of claim 1 wherein the rotation imparting means comprises:

a motor having a drive shaft rotatably coupled to the drum so that the drum rotates as an incident of the rotation of the drive shaft and a power supply to the motor so that the motor imparts rotation to the drive shaft and the braking means selectively halts rotation of the drive shaft, thereby ceasing rotation of the drum and the projecting length of cable.

4. The routing apparatus of claim 3 further including means selectively electromagnetically biasing the braking means so that it does not halt rotation of the drive shaft.

5. The routing apparatus of claim 4 wherein the braking means comprises means for halting rotation of the drive shaft and thereby stopping rotation of the drum substantially instantaneously upon cutting off the power supply to the motor.

6. The routing apparatus of claim 4 further including means for selectively preventing the braking means from braking the drum when the power supply is cut off from the motor so as to permit manual rotation of the drum for attaching implements and the like to the projecting length of cable.

7. An apparatus for routing a passageway in a conduit, the routing apparatus comprising:

an elongate cable for insertion into a conduit;

a drum containing a supply of the cable rotatable about an axis, a length of the cable supply projecting to outwardly of the drum;

means rotatably coupling the cable to the drum for imparting lengthwise rotation of the protruding length of cable as an incident of rotation of the drum about the axis;

means operatively associated with the drum for selectively imparting rotation to the drum about the axis, the imparting means, when not selectively imparting rotation to the drum, generating frictional forces tending to stop rotation of the drum; and means operatively associated with the drum for selectively braking rotation of the drum and thereby braking rotation of the protruding length of the cable.

8. The routing apparatus of claim 7 wherein the braking means comprises means for stopping rotation of the drum when the projecting length of cable is prevented from freely rotating, as by an obstruction encountered in a conduit passageway, to thereby prevent excessive torque on the protruding length of cable.

9. The routing apparatus of claim 7 wherein the braking means comprises means for substantially instantaneously stopping rotation of the drum and the projecting length of cable when the rotation imparting means is not selectively imparting rotation to the drum.

10. The routing apparatus of claim 7 wherein the rotation imparting means comprises a motor having a drive shaft rotatably coupled to the drum so that the drum rotates as an incident of the rotation of the drive shaft and a power supply to the motor so that the motor imparts rotation to the drive shaft and the braking means selectively halts rotation of the drive shaft, thereby stopping rotation of the drum and the projecting length of cable.

11. The routing apparatus of claim 10 wherein the braking means comprises means for selectively halting rotation of the drive shaft and thereby stopping rotation of the drum substantially instantaneously upon cutting off the power supply to the motor.

12. The routing apparatus of claim 11 further including means for selectively preventing the braking means from halting rotation of the drive shaft when power to the motor is cut off to permit manual rotation of the drum for attaching implements and the like to the projecting length of cable.

13. The routing apparatus of claim 10 further including means selectively electromagnetically biasing the braking means so that it does not halt rotation of the drive shaft.

14. The routing apparatus of claim 13 wherein the electromagnetic biasing means selectively biases the halting means toward a position wherein it does not halt rotation of the drive shaft when power to the motor is cut off to permit manual rotation of the drum for attaching implements and the like to the projecting length of cable.

* * * * *